US010413797B2

(12) United States Patent
Nesbitt

(10) Patent No.: US 10,413,797 B2
(45) Date of Patent: Sep. 17, 2019

(54) BICYCLE RACK ASSEMBLY

(71) Applicant: Ladson Nesbitt, Charlotte, NC (US)

(72) Inventor: Ladson Nesbitt, Charlotte, NC (US)

( * ) Notice: Subject to any disclaimer, the term of this patent is extended or adjusted under 35 U.S.C. 154(b) by 159 days.

(21) Appl. No.: 15/498,059

(22) Filed: Apr. 26, 2017

(65) Prior Publication Data

US 2018/0311559 A1 Nov. 1, 2018

(51) Int. Cl.

| | |
|---|---|
| ***A63B 69/16*** | (2006.01) |
| ***A63B 21/28*** | (2006.01) |
| ***A63B 22/06*** | (2006.01) |
| *A63B 23/04* | (2006.01) |
| *A63B 71/00* | (2006.01) |

(52) U.S. Cl.

CPC ..... *A63B 69/16* (2013.01); *A63B 21/28* (2013.01); *A63B 22/0605* (2013.01); *A63B 22/06* (2013.01); *A63B 23/0476* (2013.01); *A63B 71/0036* (2013.01); *A63B 2022/0635* (2013.01); *A63B 2022/0658* (2013.01); *A63B 2069/164* (2013.01); *A63B 2069/165* (2013.01)

(58) Field of Classification Search

CPC ..... A63B 69/16; A63B 2069/165; A63B 2069/164; A63B 21/00047; A63B 21/28; A63B 21/285; A63B 21/4027; A63B 21/4033; A63B 21/4034; A63B 22/06; A63B 22/0605; A63B 22/0635; A63B 22/0658; A63B 23/0476; A63B 71/0036; A47F 10/04; A47B 81/007; A47B 7/04; A47B 45/00; B62H 1/00; B62H 1/02; B25H 1/0014

USPC ..... 211/17, 22, 23, 24, 189, 195, 190, 175, 211/207; 248/688, 172, 440.1, 157, 419, 248/176.1, 176.3, 188.2, 118.5, 354.1, 248/354.5; 224/924

See application file for complete search history.

(56) References Cited

U.S. PATENT DOCUMENTS

| | | | | |
|---|---|---|---|---|
| 3,368,809 | A * | 2/1968 | Duane | A63B 69/16 248/125.2 |
| 4,421,308 | A | 12/1983 | Nagy | |
| D273,882 | S | 5/1984 | Bryne | |
| 4,768,777 | A | 9/1988 | Yang | |
| 5,417,629 | A | 5/1995 | Phipps | |
| 5,676,625 | A * | 10/1997 | Toth | A63B 69/16 482/61 |
| 5,743,835 | A * | 4/1998 | Trotter | A63B 69/16 434/61 |
| 6,910,992 | B2 | 6/2005 | Arguilez | |
| 7,565,990 | B2 | 7/2009 | Bryan, IV | |

(Continued)

FOREIGN PATENT DOCUMENTS

| | | |
|---|---|---|
| WO | WO2003095037 | 11/2003 |

*Primary Examiner* — Megan Anderson

(57) ABSTRACT

A bicycle rack assembly includes a first upright unit that is selectively positioned on a support surface. The first upright unit has an upper end and the upper end receives a rear axle of a first bicycle. In this way a rear wheel of the first bicycle is spaced from the support surface to spin freely when the first bicycle is mounted and pedaled. A second upright unit is slidably coupled to the first upright unit and the second upright unit is selectively positioned on the support surface. The second upright unit has a top end and the top end receives a rear axle of a second bicycle. In that way a rear wheel of the second bicycle is spaced from the support surface to spin freely when the second bicycle is mounted and pedaled.

17 Claims, 5 Drawing Sheets

(56) References Cited

U.S. PATENT DOCUMENTS

| | | | | |
|---|---|---|---|---|
| 8,439,808 | B2 | 5/2013 | Hamilton | |
| 2017/0240231 | A1* | 8/2017 | Robinson | B62H 3/08 |
| 2018/0215428 | A1* | 8/2018 | Laight | B60R 9/10 |
| 2018/0264305 | A1* | 9/2018 | Buckrell | A63B 69/16 |

* cited by examiner

BICYCLE RACK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to rack devices and more particularly pertains to a new rack device for supporting at least one bicycle thereby facilitating the at least one bicycle to be pedaled indoors for exercise.

BRIEF SUMMARY OF THE INVENTION

An embodiment of the disclosure meets the needs presented above by generally comprising a first upright unit that is selectively positioned on a support surface. The first upright unit has an upper end and the upper end receives a rear axle of a first bicycle. In this way a rear wheel of the first bicycle is spaced from the support surface to spin freely when the first bicycle is mounted and pedaled. A second upright unit is slidably coupled to the first upright unit and the second upright unit is selectively positioned on the support surface. The second upright unit has a top end and the top end receives a rear axle of a second bicycle. In that way a rear wheel of the second bicycle is spaced from the support surface to spin freely when the second bicycle is mounted and pedaled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
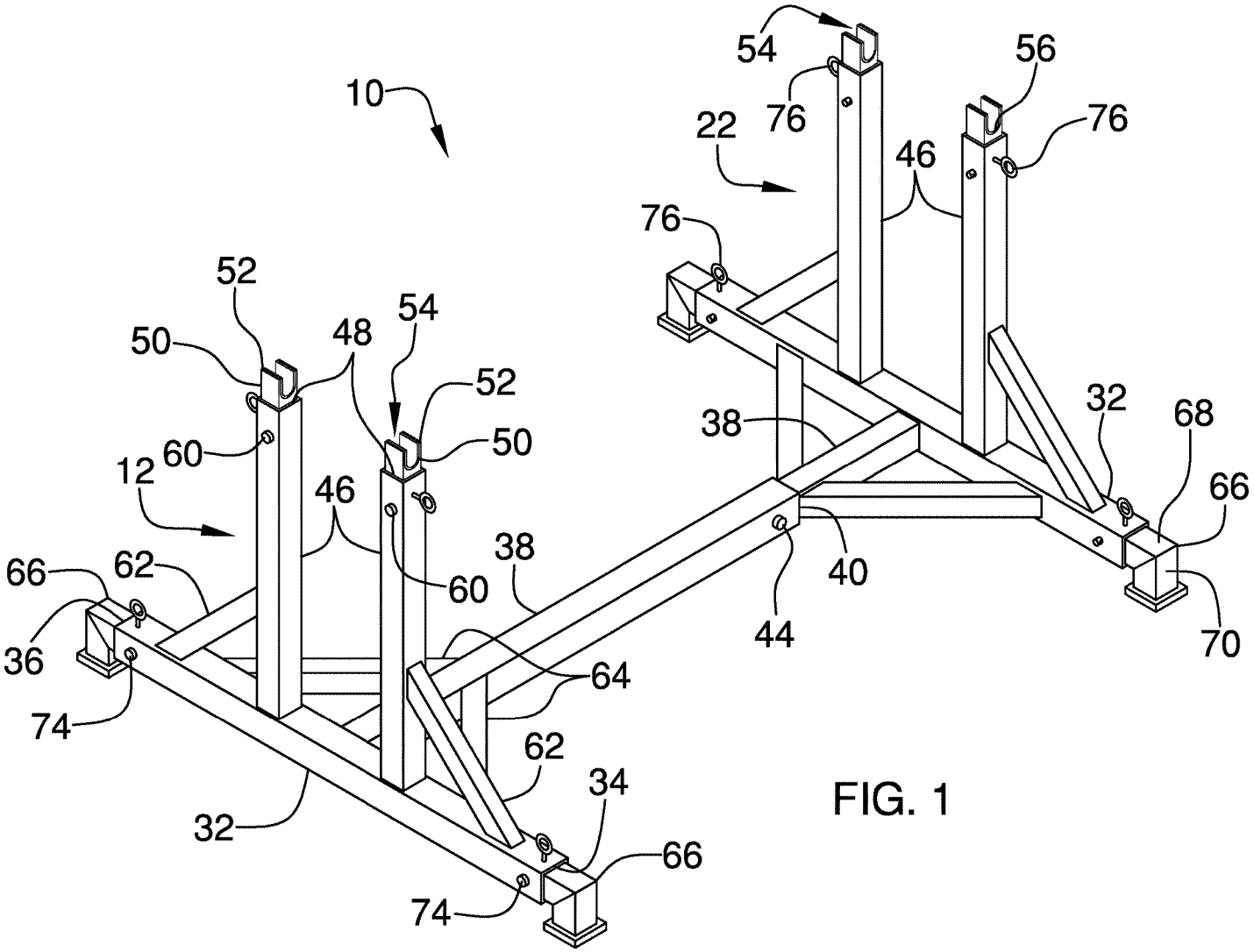
FIG. 1 is a top perspective view of a bicycle rack assembly according to an embodiment of the disclosure.
Figure 2:
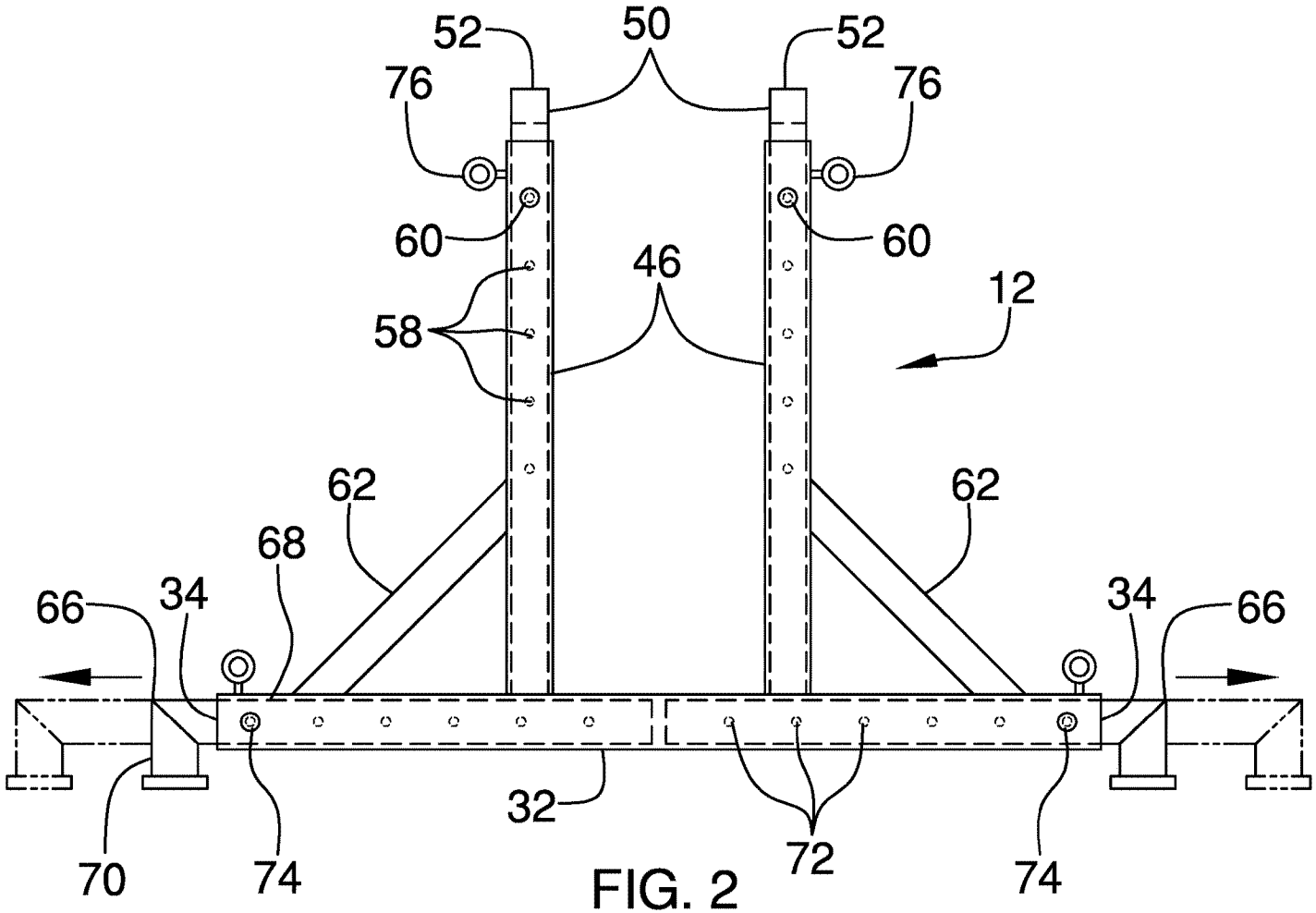
FIG. 2 is a front phantom view of an embodiment of the disclosure.
Figure 3:
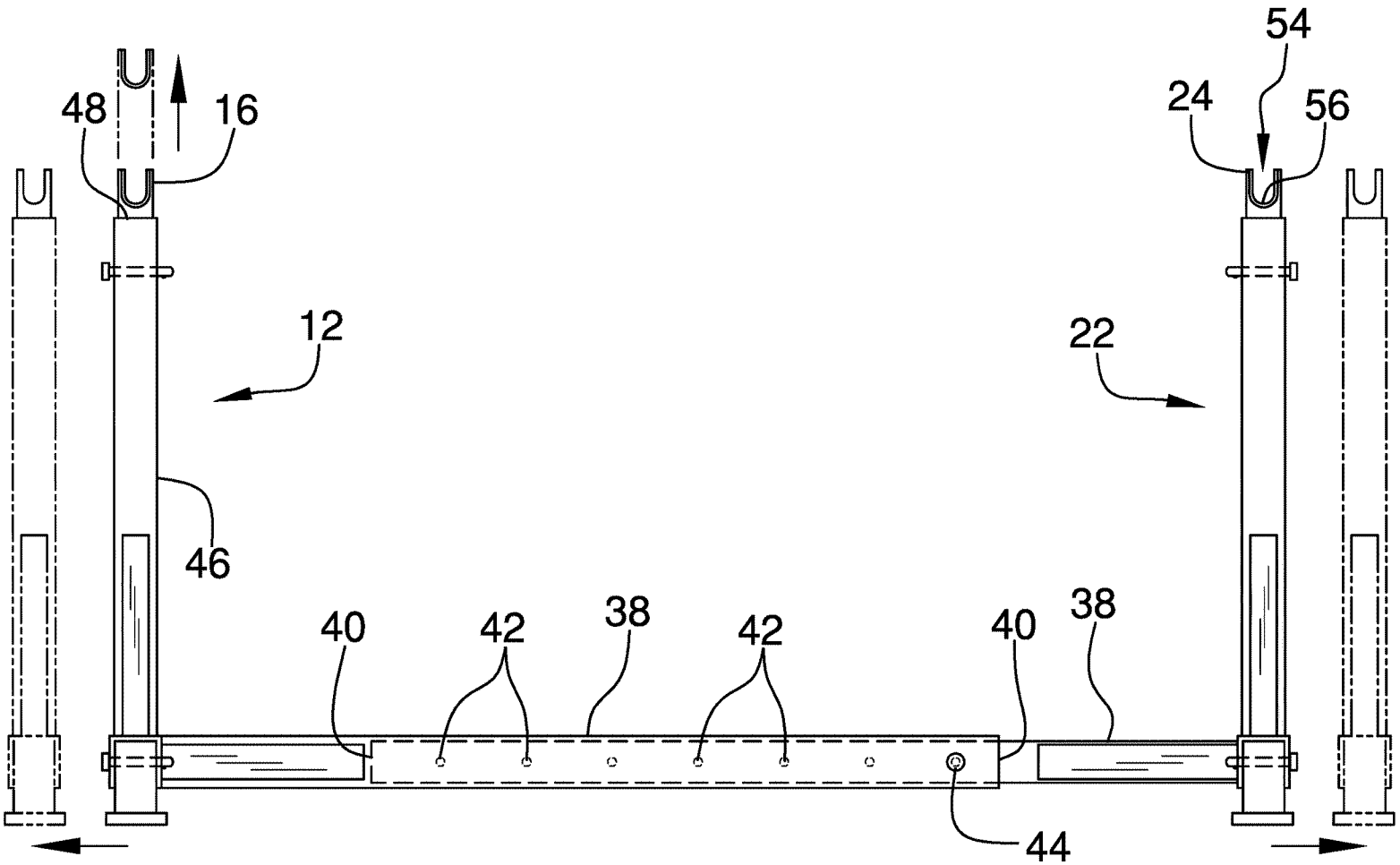
FIG. 3 is a right side phantom view of an embodiment of the disclosure.
Figure 4:
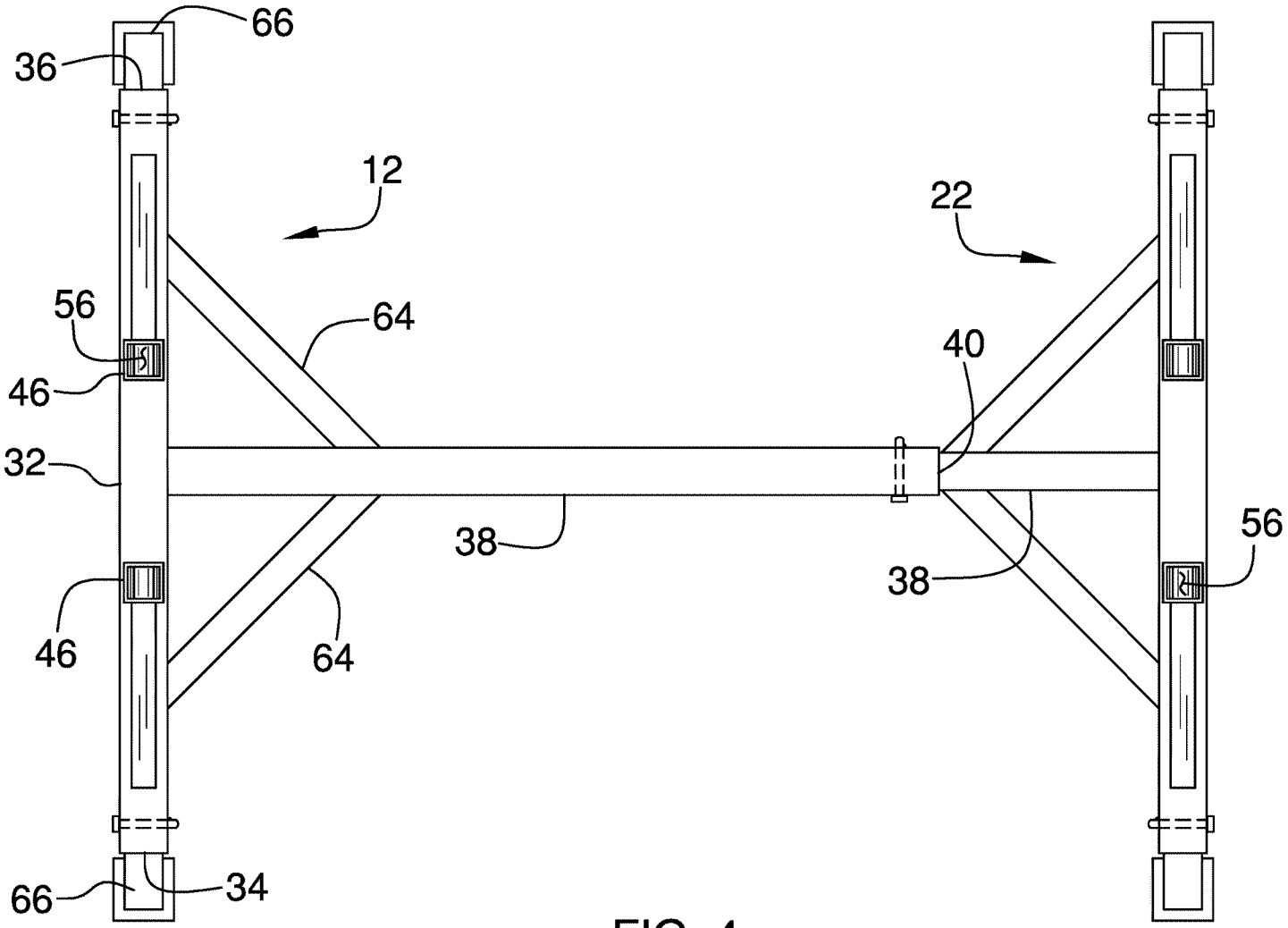
FIG. 4 is a top view of an embodiment of the disclosure.
Figure 5:
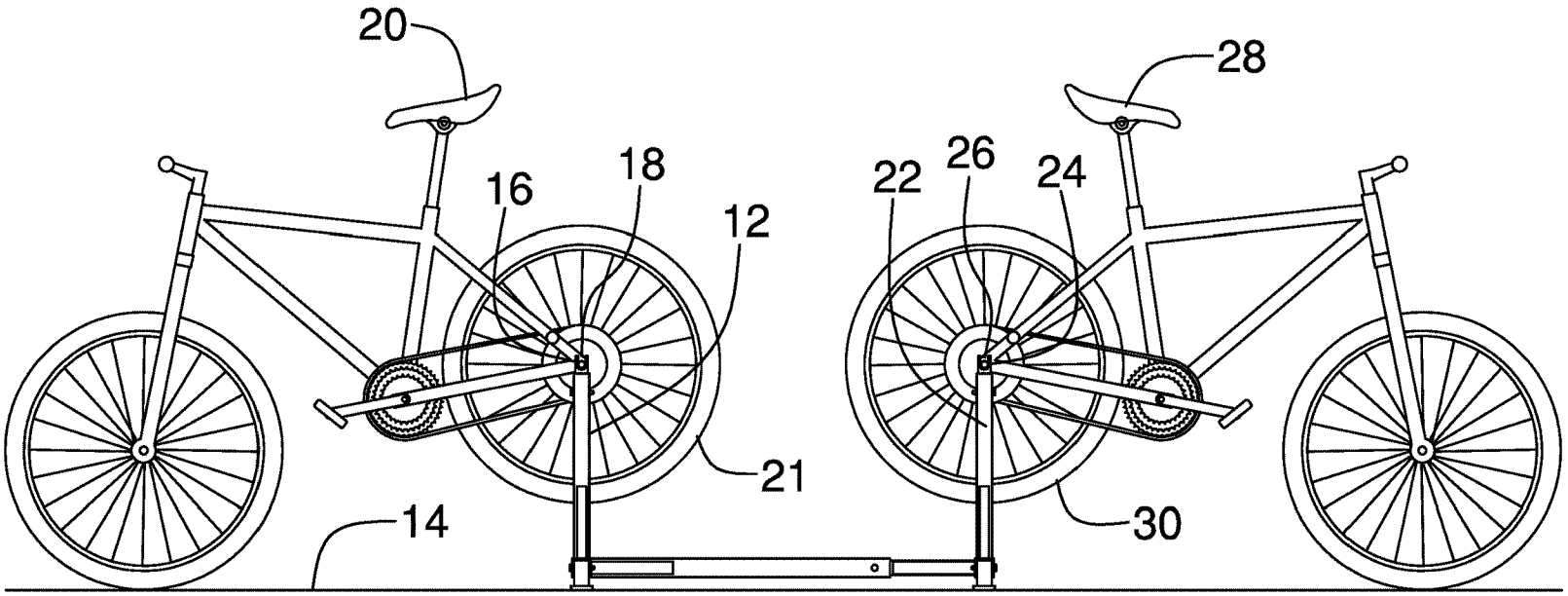
FIG. 5 is a perspective in-use view of an embodiment of the disclosure.

With reference now to the drawings, and in particular to FIGS. 1 through 5 thereof, a new rack device embodying the principles and concepts of an embodiment of the disclosure and generally designated by the reference numeral 10 will be described.

As best illustrated in FIGS. 1 through 5, the bicycle rack assembly 10 generally comprises a first upright unit 12 that is selectively positioned on a support surface 14. The support surface 14 may be a floor in a building, a roof or a vehicle or any other horizontal support surface 14. The first upright unit 12 has an upper end 16 that is spaced from the support surface 14. Moreover, a rear axle 18 of a first bicycle 20 is selectively positioned on the upper end 16 thereby facilitating a rear wheel 21 of the first bicycle 20 to spin freely when the first bicycle 20 is mounted and pedaled.

A second upright unit 22 is slidably coupled to the first upright unit 12 and the second upright unit 22 is selectively positioned on the support surface 14. The second upright unit 22 has a top end 24 that is spaced from the support surface 14. Additionally, a rear axle 26 of a second bicycle 28 is selectively positioned on the top end 24 thereby facilitating a rear wheel 30 of the second bicycle 28 to spin freely when the second bicycle 28 is mounted and pedaled. In this way each of the first 20 and second 28 bicycles may be ridden indoors in the convention of a stationary bicycle. Moreover, each of the first 20 and second 28 bicycles may be a multiple gear bicycle, a single gear bicycle or any other conventional bicycle.

Each of the first 12 and second 22 upright units include all of the elements described hereafter, including a first tube 32 that has a first end 34 and a second end 36. A member 38 is coupled to and is horizontally oriented on the first tube 32 and the member 38 is oriented perpendicular to the first tube 32. The member 38 is centrally positioned between the first 12 and second 36 ends and the member 38 has a distal end 40 with respect to the first tube 32. The distal end 40 corresponding to the first upright unit 12 is open and the member 38 of the first upright unit 12 is substantially hollow. The distal end 40 corresponding to the first upright unit 12 slidably receives the distal end 40 corresponding to the second upright unit 22. In this way the first tube 32 of the first upright unit 12 is spacable a selected distance from the first tube 32 of the second upright unit 22.

The member 38 corresponding to the second upright unit 22 has a plurality of first apertures 42 extending therethrough. The first apertures 42 are spaced apart from each other and are distributed along the corresponding member 38. A first pin 44 is selectively extended through the member 38 corresponding to the first upright unit 12. Moreover, the first pin 44 engages a selected one of the first apertures 42 in the member 38 corresponding to the second upright unit 22. The member 38 corresponding to each of the first 12 and second 28 upright units may have a length ranging between approximately 38.0 cm and 45.0 cm. In this way the first upright unit 12 may be selectively spaced from the second upright unit 22 a distance ranging between approximately 75.0 cm and 125.0 cm.

A pair of second tubes 46 is provided and each of the second tubes 46 is coupled to and is vertically oriented on the first tube 32. Each of the second tubes 46 is oriented perpendicular to the first tube 32 and each of the second tubes 46 is offset an equal distance with respect to the member 38. Each of the second tubes 46 has an uppermost end 48. A pair of supports 50 is provided and each of the supports 50 is slidably positioned in the uppermost end 48 corresponding to an associated one of the second tubes 46. Each of the supports 50 has a topmost end 52 and the topmost end 52 corresponding to each of the supports 50 has a slot 54 extending toward the associated second tube. The supports 50 may be spaced apart from each other a distance ranging between approximately 17.0 cm and 20.0 cm to accommodate a frame of the first 12 and second 22 bicycles and gear changing mechanisms of the first 12 and second 22 bicycles. Additionally, each of the supports 50 may be a minimum height of approximately 38.0 cm to ensure that the rear wheel of the first and second bicycle 28*s* is spaced from the support surface 14.

The topmost end 52 corresponding to the first upright unit 12 defines the upper end 16 of the first upright unit 12. Additionally, the topmost end 52 corresponding to the second upright unit 22 defines the top end 24 of the second upright unit 22. The slot 54 corresponding to each of the supports 50 has a lower bounding surface 56 and the lower bounding surface 56 corresponding to each of the supports 50 is concavely arcuate. In this way the lower bounding surface 56 corresponding to each of the supports 50 accommodates the rear axles 18, 26 of the associated first 20 and second 28 bicycles.

Each of the supports 50 has a plurality of second apertures 58 extending therethrough. The second apertures 58 corresponding to each of the supports 50 are spaced apart from each other and are distributed along the corresponding support. A pair of second pins 60 is provided and each of the second pins 60 is extended through an associated one of the second tubes 46. Moreover, each of the second pins 60 engages a selected one of the second apertures 58 such that the topmost end 52 corresponding to each of the supports 50 is spaced a selected distance from the uppermost end 48 of the associated second tube 46.

A pair of first restraints 62 is provided and each of the first restraints 62 extends between an associated one of the supports 50 and the first tube 32. In this way the first restraints 62 inhibit the associated support 50 from deflecting from the perpendicular orientation with respect to the first tube 32. A pair of second restraints 64 is provided and each of the second restraints 64 extends between the first tube 32 and the member 38. In this way the second restraints 64 inhibit the member 38 from deflecting from the perpendicular orientation with respect to the first tube 32.

A pair of bases 66 is provided and each of the bases 66 abuts the support surface 14. Each of the bases 66 has a leg 68 and a foot 70. The leg 68 corresponding to each of the bases 66 is slidably positioned in an associated one of the first end 34 and the second end 36 of the first tube 32. The foot 70 corresponding to each of the bases 66 abuts the support surface 14 such that each of the first tube 32 and the member 38 are spaced from the support surface 14.

The leg 68 corresponding to each of the bases 66 has a plurality of third apertures 72 extending therethrough. The third apertures 72 are spaced apart from each other and are distributed along the corresponding leg 68. A pair of third pins 74 is provided and each of the third pins 74 is extended through the first tube 32 and engages a selected one of the third apertures 72 in an associated one of the bases 66. In this way the foot 70 corresponding to each of the bases 66 is spaced a selected distance away from the first tube 32.

A plurality of eye bolts 76 is provided and each of the eye bolts 76 is coupled to an associated one of the first upright unit 12 and the second upright unit 22. Each of the eye bolts 76 is positioned at a selected location on the associated first 12 and second 22 upright units. A strap, a rope or other means of securing the first 12 and second 22 upright units to the roof of the vehicle is coupled between the eye bolts 76 and the vehicle. In this way the first 12 and second 22 upright units are retained on the vehicle to transport at least one of the first 20 and second 28 bicycles. Additionally, the selected first 20 and second 28 bicycle may be coupled to the eye bolts 76 through any conventional means. Luggage, or other objects, may be secured to each of the eye bolts 76 to transport the luggage or other objects on the roof of the vehicle.

In use, the first upright unit 12 is spaced a selected distance from the second upright unit 22 and the first pin 44 is extended through a selected one of the first apertures 42. The supports 50 corresponding to each of the first 12 and second 22 upright units are positioned at a selected height. The second pins 60 are extended through a selected one of the second apertures 58 to retain each of the supports 50 at the selected height. The rear axle 18 of the first bicycle 20 is positioned in the slots 54 corresponding to the first upright unit 12. The rear axle 26 of the second bicycle 28 is positioned in the slots 54 corresponding to the second upright unit 22. In this way each of the rear wheels 18,30 of the each of the first 20 and second 28 bicycles is spaced from the support surface 14 thereby facilitating the first 20 and second 28 bicycles to be mounted and pedaled without moving. Additionally, each of the first 12 and second 22 upright units is positioned on the roof of the vehicle to transport the selected first 12 and second 22 bicycles and other objects.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bicycle rack assembly comprising:

a first upright unit being configured to be positioned on a support surface, said first upright unit having an upper end being configured to be spaced from the support surface, said upper end being configured to have a rear axle of a first bicycle positioned thereon thereby facilitating a rear wheel of the first bicycle to spin freely when the first bicycle is mounted and pedaled; and a second upright unit being slidably coupled to said first upright unit, said second upright unit being configured to be positioned on the support surface, said second upright unit having a top end being configured to be spaced from the support surface, said top end being configured to have a rear axle of a second bicycle positioned thereon thereby facilitating a rear wheel of the second bicycle to spin freely when the second bicycle is mounted and pedaled.

2. The assembly according to claim 1, wherein each of said first and second upright units comprises:

a first tube having a first end and a second end; and a member being coupled to and being horizontally oriented on said first tube, said member being oriented perpendicular to said first tube, said member being centrally positioned between said first and second ends of said first tube, said member having a distal end with respect to said first tube, said distal end of said first upright unit being open, said member of said first upright unit being hollow.

3. The assembly according to claim 2, further comprising a pair of second tubes, each of said second tubes being coupled to and being vertically oriented on said first tube, each of said second tubes being oriented perpendicular to said first tube, each of said second tubes being offset an equal distance with respect to said member, each of said second tubes having an uppermost end.

4. The assembly according to claim 3, wherein each of the first and second upright units further comprise a pair of supports, each of said supports being slidably positioned in said uppermost end of an associated one of said second tubes, each of said supports having a topmost end, said topmost end of each of said supports having a slot extending toward said associated one of said second tubes.

5. The assembly according to claim 4, wherein each of said supports has a plurality of second apertures extending therethrough, said second apertures of each of said supports being spaced apart from each other and being distributed along said corresponding support.

6. The assembly according to claim 5, further comprising a pair of second pins, each of said second pins being extended through an associated one of said second tubes and engaging a selected one of said second apertures such that said topmost end corresponding to each of said supports is spaced a selected distance from said uppermost end of said associated second tube.

7. The assembly according to claim 4, wherein each of the first and second upright units further comprise a pair of first restraints, each of said first restraints extending between an associated one of said supports and said first tube to inhibit said associated one of said supports from deflecting from said perpendicular orientation with respect to said first tube.

8. The assembly according to claim 7, wherein each of the first and second upright units further comprise a pair of second restraints, each of said second restraints extending between said first tube and said member to inhibit said member from deflecting from said perpendicular orientation with respect to said first tube.

9. The assembly according to claim 4, wherein said topmost end of said first upright unit defines said upper end of said first upright unit, said topmost end of said second upright unit defining said top end of said second upright unit.

10. The assembly according to claim 4, wherein said slot of each of said supports has a lower bounding surface, said lower bounding surface of each of said supports being concavely arcuate wherein said lower bounding surface of each of said supports is configured to accommodate the rear axles of an associated one of the first and second bicycles.

11. The assembly according to claim 2, wherein each of the first and second upright units further comprise a pair of bases, each of said bases being configured to abut the support surface, each of said bases having a leg and a foot.

12. The assembly according to claim 11, wherein said leg of each of said bases has a respective plurality of third apertures extending therethrough.

13. The assembly according to claim 12, further comprising a pair of third pins, each of said third pins being extended through said first tube and engaging a selected one of said third apertures in an associated one of said bases such that the foot corresponding to each of said bases is spaced a selected distance away from said first tube.

14. The assembly according to claim 2, wherein said member of said second upright unit has a plurality of first apertures extending therethrough, said plurality of first apertures being spaced apart from each other and being distributed along said member of said second upright unit.

15. The assembly according to claim 14, further comprising a first pin being extended through said member of said first upright unit and engaging a selected one of said first apertures of said member of said second upright unit.

16. The assembly according to claim 2, wherein said distal end of said first upright unit slidably receives said distal end of said second upright unit such that said first tube of said first upright unit is spacable a selected distance from said first tube of said second upright unit.

17. A bicycle rack assembly comprising:

a first upright unit being configured to be positioned on a support surface, said first upright unit having an upper end being configured to be spaced from the support surface, said upper end being configured to have a rear axle of a first bicycle positioned thereon thereby facilitating a rear wheel of the first bicycle to spin freely when the first bicycle is mounted and pedaled;

and a second upright unit being slidably coupled to said first upright unit, said second upright unit being configured to be positioned on the support surface, said second upright unit having a top end being configured to be spaced from the support surface, said top end being configured to have a rear axle of a second bicycle positioned thereon thereby facilitating a rear wheel of the second bicycle to spin freely when the second bicycle is mounted and pedaled;

wherein each of said first and second upright units comprising:

a first tube having a first end and a second end, a member being coupled to and being horizontally oriented on said first tube, said member being oriented perpendicular to said first tube, said member being centrally positioned between said first and second ends, said member having a distal end with respect to said first tube;

a pair of second tubes, each of said second tubes being coupled to and being vertically oriented on said first tube, each of said second tubes being oriented perpendicular to said first tube, each of said second tubes being offset an equal distance with respect to said member, each of said second tubes having an uppermost end;

a pair of supports, each of said supports being slidably positioned in said uppermost end of an associated one of said second tubes, each of said supports having a topmost end, said topmost end of each of said supports having a slot extending toward said associated second tube;

a pair of first restraints, each of said first restraints extending between an associated one of said supports and said first tube to inhibit said associated support from deflecting from said perpendicular orientation with respect to said first tube; and a pair of second restraints, each of said second restraints extending between said first tube and said member to inhibit said member from deflecting from said perpendicular orientation with respect to said first tube, a pair of bases, each of said bases being configured to abut the support surface, each of said bases having a leg and a foot;

wherein said distal end of said first upright unit being open, said member of said first upright unit being hollow, said distal end corresponding to said first upright unit slidably receiving said distal end of said second upright unit such that said first tube of said first upright unit is spacable a selected distance from said first tube of said second upright unit, said member of said second upright unit having a plurality of first apertures extending therethrough, said first apertures being spaced apart from each other and being distributed along said member of said second upright, a first pin being extended through said member of said first upright unit and engaging a selected one of said first apertures in said member of said second upright unit, said topmost end of said first upright unit defining said upper end of said first upright unit, said topmost end of said second upright unit defining said top end of said second upright unit, said slot of each of said supports having a lower bounding surface, said lower bounding surface of each of said supports being concavely arcuate wherein said lower bounding surface of each of said supports is configured to accommodate the rear axle of an associated one of the first and second bicycles, each of said supports having a plurality of second apertures extending therethrough, said second apertures corresponding to each of said supports being spaced apart from each other and being distributed along said supports, a pair of second pins, each of said second pins being extended through an associated one of said second tubes and engaging a selected one of said second apertures such that said topmost end of each of said supports is spaced a selected distance from said uppermost end of said respective second tube.

* * * * *